United States Patent [19]

Schaloske et al.

[11] 4,222,683

[45] Sep. 16, 1980

[54] OFFSHORE CONSTRUCTION

[75] Inventors: Peter Schaloske, Oberhausen; Wolfgang Küffel, Duisburg; Franz J. Brinkmann, Mülheim, all of Fed. Rep. of Germany

[73] Assignee: Deutsche Babcock Aktiengesellschaft, Oberhausen, Fed. Rep. of Germany

[21] Appl. No.: 936,172

[22] Filed: Aug. 23, 1978

[30] Foreign Application Priority Data

Sep. 21, 1977 [DE] Fed. Rep. of Germany ..... 2742459
Apr. 1, 1978 [DE] Fed. Rep. of Germany ..... 2814080

[51] Int. Cl.[3] ..... E02D 25/00

[52] U.S. Cl. ..... 405/204; 403/13; 405/195; 405/203

[58] Field of Search ..... 405/197, 204, 206, 207, 405/208, 209, 203; 403/13, 14; 248/544, 546; 166/359, 367, 355; 267/160, 161, 163, 181

[56] References Cited

U.S. PATENT DOCUMENTS

| | | | |
|---|---|---|---|
| 1,190,491 | 7/1916 | Watts et al. | 403/13 |
| 2,342,458 | 2/1944 | Davies | 267/161 X |
| 2,907,172 | 10/1959 | Crake | 405/209 |
| 3,080,160 | 3/1963 | Orner | 267/160 |
| 3,261,598 | 7/1966 | Jones | 267/163 X |
| 3,528,254 | 9/1970 | Graham | 405/204 |
| 3,712,604 | 1/1973 | Nation | 267/161 |
| 3,744,561 | 7/1973 | Shatto et al. | 166/359 |
| 4,069,992 | 1/1978 | Lada | 248/544 |
| 4,073,155 | 2/1978 | Schiemichen | 405/197 |

*Primary Examiner*—Dennis L. Taylor
*Attorney, Agent, or Firm*—Max Fogiel

[57] ABSTRACT

An offshore construction arrangement in which a platform is provided with raisable and lowerable support legs which engage a substructure resting on the sea bed. The parts lie on one another in a solid support surface and engage over one another while maintaining a funnel-shaped gap. Spring elements are located between side walls of the substructure and end portions of the legs, and the spring elements are supported on one of the side walls. The spring elements are displaceable in horizontal and vertical directions, and they are constructed as leaf springs arranged in a funnel. The leaf springs protrude beyond the rim of the funnel and are pre-bent inwardly. The leaf springs, furthermore, may be supported by lateral springs, and an auxiliary funnel may be used to receive the spring elements while being exchangeably arranged in the first-mentioned funnel. The spring elements may be in the form of several blocks of elastic material and spaced from each other. The blocks may also be provided with a slide rail on their side facing the interior of the first-mentioned funnel.

15 Claims, 9 Drawing Figures

OFFSHORE CONSTRUCTION

Figure 1:
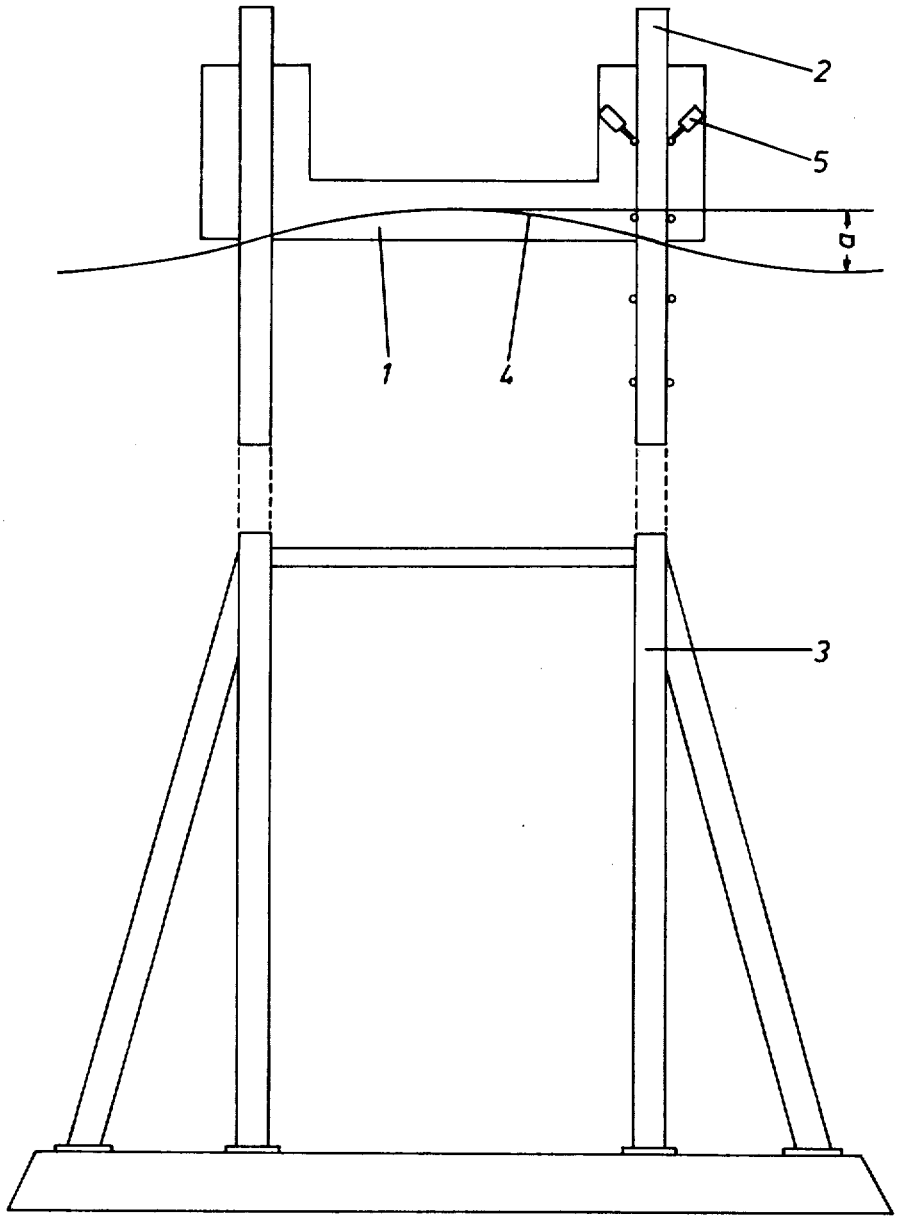

The invention concerns an offshore construction, the platform of which is provided with raisable and lowerable support legs, which are supported on a substructure resting on the sea bed, wherein these parts lie on one another in a solid support surface and engage over one another while maintaining a funnel-shaped gap.

Offshore constructions of that kind are watercraft used for certain constructional tasks at sea or offshore drills. To produce the working position, the support legs are lowered down to the sea bed and the platform is then raised up out of the water on the firmly seating support legs until the required height above the sea level is reached. The placing of the support legs on the substructure is always a critical operation which can be performed only in favourable weather conditions. The platform oscillating up and down with the waves can in unfavourable sea conditions impact on the substructure several times by the support legs driving out before it finally stands fast. This can lead to appreciable damage.

Although the funnel-shaped formation of the ends of the support legs or of the substructure facilitates the introduction of the support legs during the placing process, the blows nevertheless have their effect on the substructure and the support legs.

The invention is based on the task of constructing the ends of the support legs and the substructure in such a manner that the impacts acting on them during the placing process due to the motion of the platform caused by the waves are avoided.

This problem is thereby solved according to the invention, proceeding from a platform of the initially named kind, that spring elements are provided between the side walls of the two ends and supported on one of the side walls. Preferably, these spring elements display spring travels running in horizontal and vertical direction. The spring elements can be constructed as leaf springs or consist of several buffers of elastic material arranged at a spacing.

Should a support leg in this offshore construction impact on the concerned funnel of the substructure, then the impacts are damped in horizontal and vertical direction and the blows impinging on the substructure are moderated. When the support leg slides further into the funnel, then a guidance takes place, which however displays a certain elasticity. The springs yield, while the leaf springs increasingly bear down further outwardly. In the final state, the support leg bears force-lockingly against the solid support surface. The leaf springs let themselves be so dimensioned that they are functionally still effective even when they have been exposed to the sea water for 5 to 6 years.

In order with this arrangement to obtain a better guidance of the support legs at the instant of setting down, it is provided in further development of the invention, that a guide ring is connected through the spring elements with each support leg, that the guide ring surrounds the bearing of the support leg and protrudes beyond it in axial direction and that the inclination of the guide ring is adapted to the side walls of the bearing in the substructure. In this case, the functions of guidance of the support leg and damping of the blows are separated from one another. The specially constructed guide ring takes over the task of guiding the support leg which in some circumstances due to the waves is lowered inclined to the substructure. The spring elements need now only still absorb the blows. In this manner, the difficult putting-down of the support legs onto the substructure lets itself be managed securely.

In advantageous development of the invention, it can be provided that the spring elements are supported on piston rods, which are displaceable in longitudinal direction of the support legs and the cylinders of which are mounted to the support legs. The spring elements can be relieved in the operating position of the platform through these cylinder arrangements. Should the platform be removed from the substructure after a certain space of time, then the spring elements are to be loaded anew before the lifting-off of the support legs. With the spring elements loaded, impacts from the wave motion are absorbed also during the lifting-off of the platform.

Further details of the invention are characterised in the subclaims. Aeveral examples of embodiment of the invention are illustrated in the drawing and more closely described in the following.

There show

FIG. 1 an offshore construction, with platform and substructure

Figure 2:
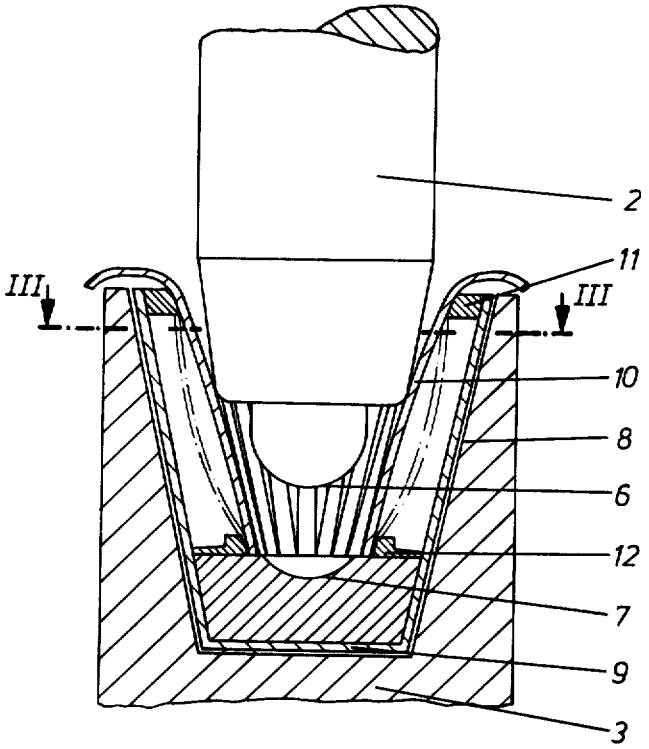
Figure 3:
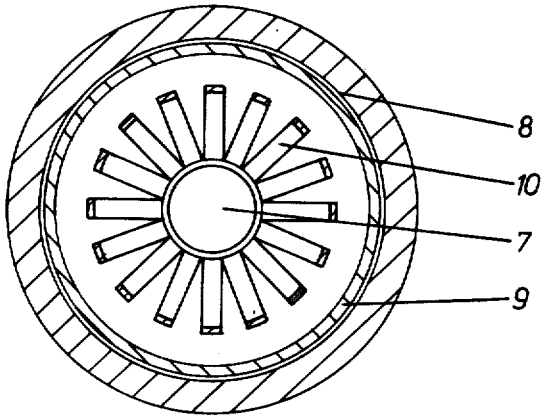
Figure 4:
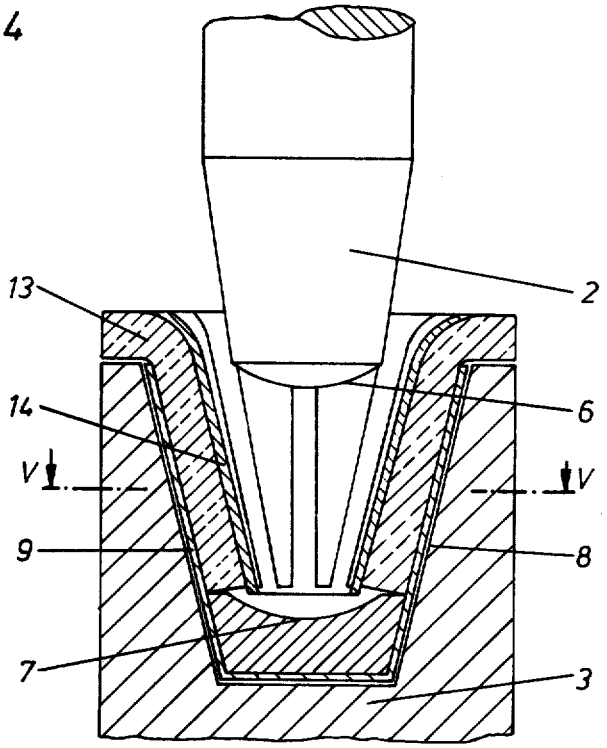
Figure 5:
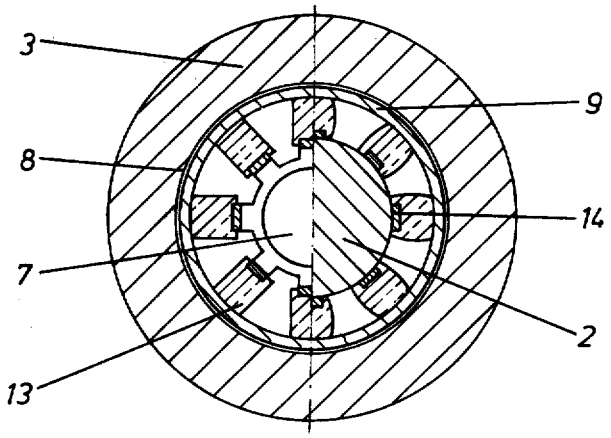
Figure 6:
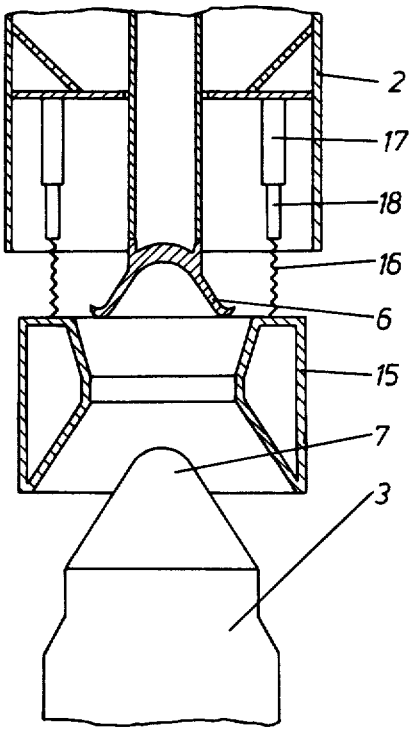
Figure 7:
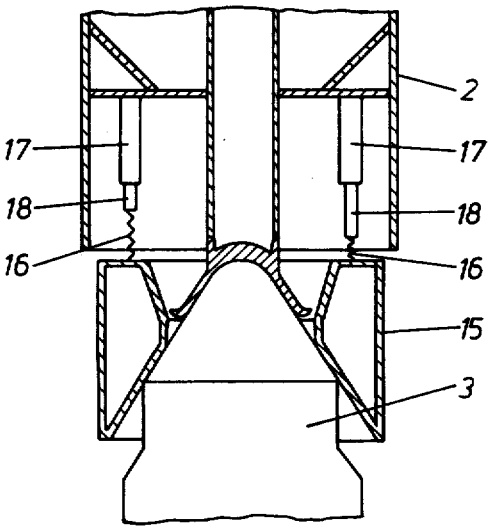
Figure 8:
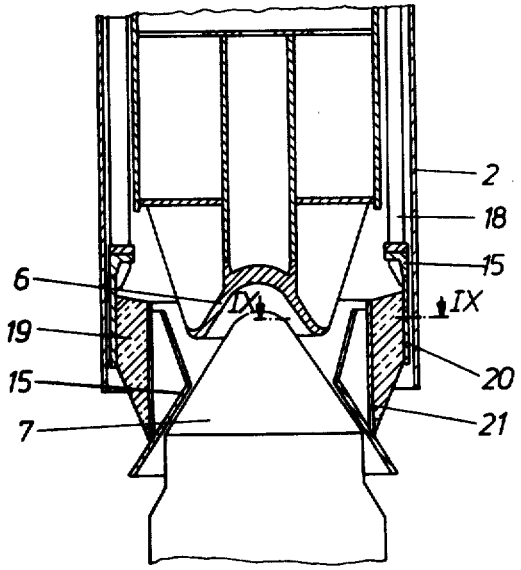
Figure 9:
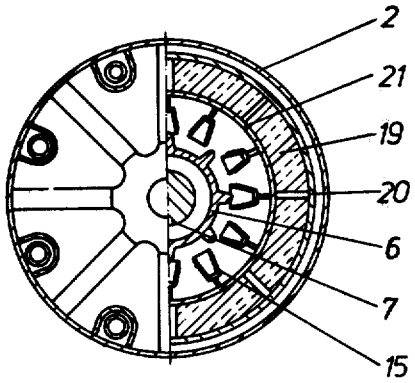

FIG. 2 the inter-engaging ends of support legs and substructure,

FIG. 3 the section III—III according to FIG. 2,

FIG. 4 the interengaging ends of support leg and substructure according to another embodiment, FIG. 5 the section V—V according to FIG. 4, FIG. 6 schematically, the mutually opposite ends of the support legs and the substructure according to a further embodiment before the setting down, FIG. 7 the mutually opposite ends of the support legs and the substructure after the setting down, FIG. 8 the mutually opposite ends of the support legs and the substructure according to another embodiment and FIG. 9 the section IX—IX according to FIG. 8.

The illustrated offshore construction consists of the platform 1 and the raisable and lowerable support legs 2. The support legs 2 bear in the working position of the platform 1 on a substructure 3, previously lowered and resting on the sea bed.

The platform 1 is buoyant and towed by deep sea tugs to the envisaged place of erection at sea. During the operations for the erection, the platform 1 floats on the sea surface and is in that case more or less strongly raised and again lowered according to the height of the waves. In FIG. 1, the sea level is indicated by the line 4, wherein the wave height is designated by a.

The hydraulic drive for the support legs 2 consists of several hydraulic stroke cylinders 5, which are arranged uniformly distributed over the periphery of each support leg 2. The hydraulic cylinders 5 bear articulatedly on the platform 1 and engage at the support legs 2.

According to the FIGS. 2 and 4, each support leg 2 is provided with a fixed bearing support 6, to which a correspondingly constructed counterbearing 7 stands opposite in the upper end of the substructure 3. When the support leg 2 is lowered down, the bearing 6 rests force-lockingly on the counterbearing 7. The substructure 3 consists of steel or of concrete and is enlarged in the shape of a funnel in the upper part for the formation of a receiving funnel 8 for the support leg 2. In that case, a gap remains free between the receiving funnel 8 and the side walls of the support leg 2. In departure from the embodiment illustrated here, the support leg 2 can also be provided with the receiving funnel 8 and encompass the upper end of the substructure 3. This construction has the advantage that after a raising of the platform 1 off from the substructure 3, the receiving funnels 8 together with the remaining equipments of the platform 1 can be checked over in the dock yard.

A further funnel 9 is exchangeably arranged in the receiving funnel 8. The space between the receiving funnel 8 and this further funnel 9 is backfilled with balancing means.

Spring elements are provided in the space between the side walls of the ends of the support leg 2 and the receiving funnel 8 of the substructure 3. When the further funnel 9 is inserted in the receiving funnel 8, then the former receives the spring elements. In the embodiment illustrated in FIG. 2, the spring elements are constructed as leaf springs 10 and shaped to be funnel-shaped. The leaf springs 10 bear on the funnel 9 through upper and lower webs 11 and 12. To increase the spring effect, the springs 10 can be pre-bent inwardly. Furthermore, the upper webs 11 can be produced of resilient material. In case of need, further springs are to be provided between the upper and lower webs 11 and 12. The leaf springs 10 are drawn over the rim of the receiving funnel 8 in order in this manner to protect the rim against damage during the lowering of the support leg 2.

During the downward motion, the support leg 2 impinges at first on the leaf springs 10 disposed in its stroke travel. These damp possible impacts so that they do not load substructure 3. With increasing lowering of the support legs 2, the leaf springs 10 bend outwardly. It is indicated by dashed lines in FIG. 2 which shape the leaf springs 10 assume when the support leg 2 by its bearing 6 seats on the counterbearing 7.

Apart from the illustrated leaf spring 10, which are shaped to be funnel-shaped, other springs, for example spring packets oer helical springs, which support metal plates, can also be used.

According to FIG. 4, the spring elements consist of blocks 13 of elastic material, for example rubber or synthetic material. These blocks 13 are arranged at a spacing from one another in the circumferential direction of the receiving funnel 8 and fastened to the funnel 9. If the funnel 9 is absent, then the blocks are placed directly on the receiving funnel 8. The blocks 13 receive metallic slide rails 14 of corrosion-resistant steel or another metal alloy on their side facing the interior of the funnel. The slide rails 14 protrude in the unloaded state of the blocks 13 beyond their surface. Without these slide rails 14, the support leg 2 would be too strongly braked by the elastic material of the blocks 13 during the downward motion. The blocks 13 and the slide rails 14 protrude beyond the upper rim of the receiving funnel 8.

In the embodiment illustrated in FIG. 4, the lower end of the support leg 2 is constructed to be more strongly conical than according to FIG. 2. In that case, the inclination of the slide rails 14 is largely adapted to the inclination of the conical end of the support leg 2. This results in a good bearing of the support leg 2 against the slide rails 14.

The structural change, which the blocks 13 assume through elastic deformation, is illustrated in FIG. 5. The blocks 13 are reproduced in the unloaded initial state in the left hand partial figure. The right hand partial figure shows the blocks 13 in the deformed state with the support leg 2 seating firmly.

According to the FIGS. 6 to 9, the bearing 6 of each support leg 2 is constructed to be skirt-shaped and placed on the correspondingly shaped surface of the counterbearing 7 of the substructure 3. The bearing 6 is surrounded by a guide ring 15, the internal diameter of which is greater than the diameter of the bearing 6. The guide ring 15 protrudes downwardly beyond the lower end of the support leg 2. The inclination of its inwardly lying surface is matched to the side walls of the counterbearing 7 of the substructure 3. In that case, for secure guidance, the greatest diameter of the conically constructed guide ring 15 is greater than the greatest diameter of the counterbearing 7. With the support leg 2 firmly seated, the guide ring 15 therefore protrudes beyond the cone of the counterbearing 7.

The guide ring 15 is connected through springs 16 with the support leg 2. The springs 16, which are uniformly distributed over the cross-section of the guide ring 15 are illustrated in the FIGS. 6 and 7 as helical springs for clarification of the principle of operation. The impacts due to the wave motion of the platform are absorbed through these springs 16 during the setting-down operation of the support leg 2 onto the substructure 3. When the bearing 6 at the end of the setting-down operation is seated force-lockingly on the counterbearing 7, then the guide ring 15 likewise bears against the counterbearing 7. In that case, the springs 16 are loaded as is shown in the right hand part picture of the FIG. 7.

Hydraulic cylinders 17 are so mounted to each support leg that their piston rods 18 are displaceable in longitudinal direction of the support leg 2. The springs 16 bear against these piston rods 18. When the bearing 6 has reached the position illustrated in FIG. 7, then the cylinders 17 are loaded with pressure medium and the piston rods 18 displaced so far until the springs 16 are relieved. (FIG. 7, left hand half). In that case, the guide ring 15 retains its assumed postion. Should the platform 1 be raised from the substructure 3 after a certain operating time, then the cylinders 17 are loaded initially, whereby the piston rods 18 are displaced in opposite direction and the springs 16 are loaded. The arrangement of the cylinders 17 has the advantage that the springs 16 are relieved during the operating time of the platform 1.

Should the danger exist during the setting-down process that the springs 16 are overloaded, then a blow-off duct can be provided at the cylinders 17. The blow-off duct opens when the permissable loading of the springs 16 is reached. The springs 16 are then relieved by a certain amount through a displacing of the piston rods 18.

In the embodiment illustrated in the FIGS. 8 and 9, the springs 16 were replaced by a buffer 19 of rubber and likewise acting as spring element. The buffer is loaded in shear and fastened between two concentrically arranged steel rings 20 and 21, for example through an adhesive connection. The outer steel ring 20 is connected through a carrier ring 22 with the piston rods 18 of the cylinders 17. The inner steel ring 21 is connected to the guide ring 15. The steel rings 20 and 21 are in this manner displaceable in longitudinal direction of the support leg 2, while their relative motion is damped by the buffer 19. While the two steel rings 20 and 21 are continuous, the buffer 19 is divided up into segments, wherein the individual segments are arranged with lateral spacing from one another.

What is claimed is:

1. An offshore construction arrangement, comprising: a platform having raisable and lowerable support legs; substructure means for resting on a sea bed and supporting said legs; said legs engaging said substructure at a solid support surface and maintaining a funnel-shaped gap therebetween; and spring means in said funnel-shaped gap between side walls of said substructure and end portions of said legs, said spring means being supported on one of said side walls.

2. An offshore construction arrangement as defined in claim 1, wherein said spring means comprises spring elements having spring tracks whereby said spring elements are displaceable in horizontal and vertical directions.

3. An offshore construction arrangement as defined in claim 1, wherein said spring means comprises spring elements in form of a plurality of blocks of elastic material and spaced from each other.

4. An offshore construction arrangement as defined in claim 3, wherein said spring elements are arranged within a funnel; and slide rail means on a side of said blocks facing the interior of said funnel.

5. An offshore construction arrangement as defined in claim 1, wherein said spring means comprises spring elements; piston rods supporting said spring elements and being displaceable in longitudinal direction of a support leg; and cylinders mounted to the support leg and receiving said pistons; said pistons being slidable independent of said spring elements.

6. An offshore construction arrangement as defined in claim 5, wherein said spring elements are relieved by said cylinders.

7. An offshore construction arrangement as defined in claim 5, including buffer means fastened between two concentrically arranged steel rings displaceable axially relative to one another, one of said steel rings being connected to said cylinders.

8. An offshore construction arrangement as defined in claim 1, wherein said spring means comprises spring elements having spring tracks whereby said spring elements are displaceable in horizontal and vertical directions; said spring elements being in the form of rubber-like elements spaced from each other; guide ring means connected to a supporting ring by said spring elements; piston rods supporting said spring elements and being displaceable in longitudinal direction of a support leg; cylinders mounted to the support leg and receiving said pistons, said pistons being slidable independent of said spring elements, said piston rods relieving said spring elements of load during the life-span of said platform.

9. An offshore construction arrangement, comprising: a platform having raisable and lowerable support legs; substructure means for resting on a sea bed and supporting said legs; said legs engaging said substructure at a solid support surface and maintaining a funnel-shaped gap therebetween; and spring means between side walls of said substructure and end portions of said legs, said spring means being supported on one of said side walls and comprising leaf spring elements arranged to form a funnel.

10. An offshore construction arrangement as defined in claim 9, wherein said leaf springs protrude beyond the rim of said funnel and are pre-bent inwardly.

11. An offshore construction arrangement as defined in claim 9, including lateral springs for supporting said leaf spring elements.

12. An offshore construction arrangement as defined in claim 9, including an auxiliary funnel for receiving said spring elements and being exchangeably arranged in said first-mentioned funnel.

13. An offshore construction arrangement as defined in claim 12, including balancing mass means for backfilling said auxiliary funnel.

14. An offshore construction arrangement, comprising: a platform having raisable and lowerable support legs; substructure means for resting on a sea bed and supporting said legs; said legs engaging said substructure at a solid support surface and maintaining a funnel-shaped gap therebetween; and spring means between side walls of said substructure and end portions of said legs; said spring means being supported on one of said side walls; guide ring means connected to each support leg through said spring means, said guide ring means surrounding a bearing portion of the support leg and protruding beyond it in radial direction, said guide ring means having an inclination matched to side walls of a bearing surface in said substructure means receiving said bearing portion of said support leg.

15. An offshore construction arrangement as defined in claim 14, wherein said guide ring means has a conical shape with greatest diameter larger than the greatest diameter of said bearing surface in said substructure means for receiving said bearing portion of the support leg.

* * * * *